United States Patent [19]

Hiramatsu et al.

[11] Patent Number: 4,848,255

[45] Date of Patent: Jul. 18, 1989

[54] AUTOMATIC SEWING MACHINE EXCLUSIVELY USED FOR SEWING ZIPPER ON WORKPIECE

[75] Inventors: Tohru Hiramatsu; Kazuya Tami; Torao Ohchi, all of Tokyo, Japan

[73] Assignee: Tokyo Juki Industrial Co., Ltd., Tokyo, Japan

[21] Appl. No.: 183,718

[22] Filed: Apr. 19, 1988

Related U.S. Application Data

[62] Division of Ser. No. 882,884, filed as PCT JP84/00509 on Oct. 25, 1984, published as W86/02672 on Mar. 9 1986

[51] Int. Cl.[4] ..... D05B 35/00

[52] U.S. Cl. ..... 112/147; 112/104; 112/113

[58] Field of Search ..... 112/147, 136, 153, 70, 112/76, 77, 104, 114, 113, 110, 112, 121.26, 121.27, 121.29

[56] References Cited

U.S. PATENT DOCUMENTS

| | | | |
|---|---|---|---|
| 3,750,604 | 8/1973 | Carrel et al. | 112/70 X |
| 4,034,689 | 7/1977 | Hintzen | 112/70 X |
| 4,562,782 | 1/1986 | Doucette et al. | 112/104 |
| 4,580,512 | 4/1986 | Nakatani et al. | 112/147 |
| 4,606,287 | 8/1986 | Papajewski et al. | 112/121.27 |
| 4,648,335 | 3/1987 | Hiramatsu et al. | 112/114 |

FOREIGN PATENT DOCUMENTS

| | | |
|---|---|---|
| 20010 | 7/1970 | Japan . |
| 46341 | 11/1980 | Japan . |
| 17068 | 2/1981 | Japan . |

*Primary Examiner*—H. Hampton Hunter

*Attorney, Agent, or Firm*—Tarolli, Sundheim & Covell

[57] ABSTRACT

This invention relates to an automatic sewing machine exclusively used for sewing a zipper on a workpiece and its related art. The automatic sewing machine exclusively used for sewing a zipper on a workpiece comprises a sewing machine (10, 20) capable of at least sewing linearly, a drive device movable in two axes right angles to each other in a plane vertical to the movement direction of the needle (11, 21) of the sewing machine and a zipper setting device (12, 22) attached to said drive device for gripping said zipper (3) and workpiece (1) in a predetermined relationship.

3 Claims, 13 Drawing Sheets

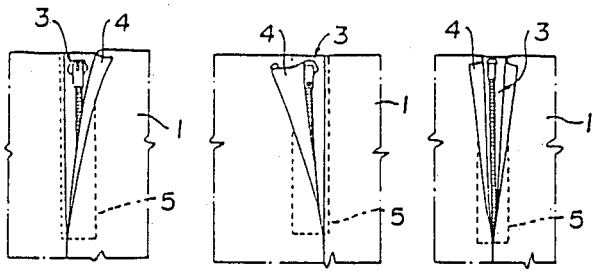
FIG. 1A FIG. 1B FIG. 1C
FIG. 2A
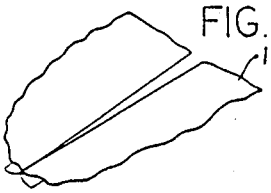
FIG. 2B
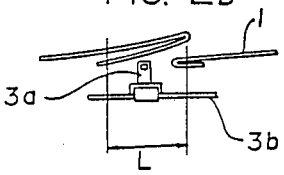
FIG. 3A
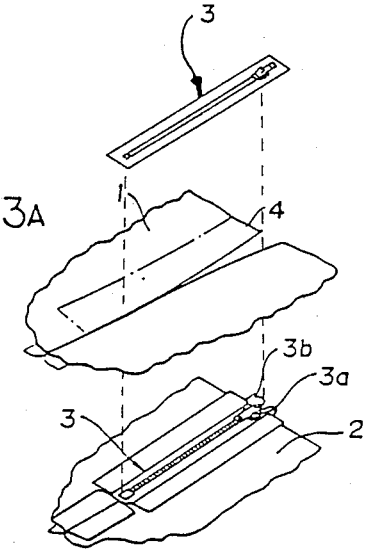
FIG. 3B
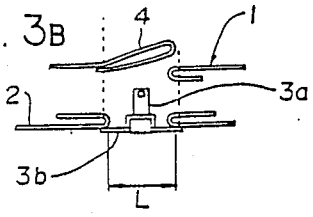

FIG. 11
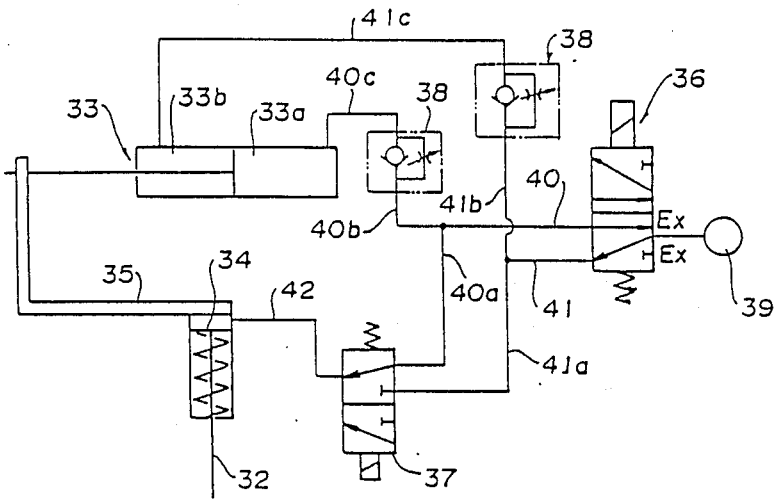
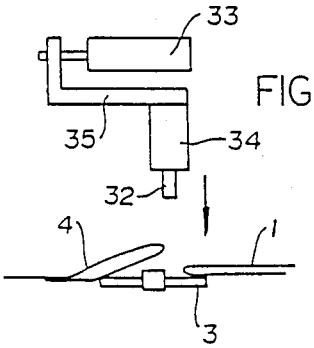
FIG. 12A
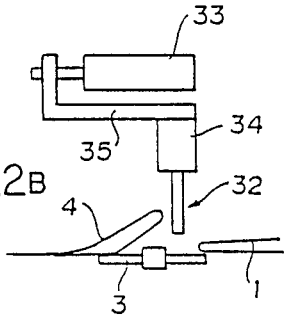
FIG. 12B
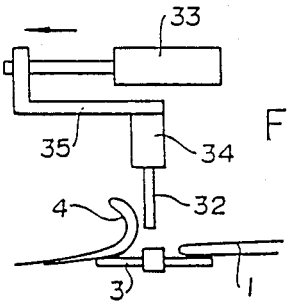
FIG. 12C

AUTOMATIC SEWING MACHINE EXCLUSIVELY USED FOR SEWING ZIPPER ON WORKPIECE

This is a divisional of co-pending application Ser. No. 882,884, filed as PCT JP84/00509 on Oct. 25, 1984, published as WO86/02672 on Mar. 9, 1986.

TECHNICAL FIELD

This invention relates to an automatic sewing machine exclusively for sewing a zipper on a flapped product, for example, a workpiece to be sewn such as a skirt or the like and to a related art thereof.

BACKGROUND TECHNOLOGY

The conventional sewing process will be describe by way of the sewing of a zipper on a skirt. FIGS. 1(A-)-(C) show three different types of flaps (each of which is the portion of the skirt covering the zipper) of a workpiece. FIGS. 2(A) and (B) are exploded perspective and right-hand side elevational views, respectively, of a workpiece without a lining sewn thereon and FIGS. 3(A) and (B) are exploded perspective and right-hand side elevational views, respectively, of a workpiece with a lining sewn thereon which show relationship between parts of the workpieces, respectively.

In these FIGS., 1 is the surface cloth, 2 is the lining, 3 is the zipper having the slider 3*a* and fastener tapes 3*b*, 3*b* and 4 is the flap of the workpiece 1. There are three different types of flaps as shown in FIGS. 1(A) (C).

As shown in FIGS. 2(A) and 3(A) the zipper 3 is sewn by the sewing width L on the surface cloth 1*a* which is unlined or lined. FIGS. 4(A)-(F) show the conventional sewing process when the flap is a left flap. FIG. 4(A) shows the initial sewing step in which the slider 3*a* is retracted to substantially the central area of the length of the zipper 3. As shown in FIG. 4(A), the operator starts to sew the zipper 3 on the workpiece at the leading left-hand side corner thereof with his both hands placed on the surface cloth 1 on the opposite sides of the zipper 3. After the flap has been sewn at its inner side edge on the zipper 3 halfway in the longitudinal direction of the zipper 3, the sewing machine 10 is once stopped and the slider 3*a* is pulled to the leading end of the zipper (FIG. 4(B)). This is to prevent the needle 11 from inadvertently interfering with the slider 3*a*. The sewing operation then continues to a predetermined position in the longitudinal direction of the zipper and the workpiece is rotated by 90° in the arrow direction with the needle held in its lowered position (FIG. 4(C)). The sewing operation progresses along the trailing end of the zipper 3 by the sewing width L and the workpiece is again rotated by 90° in the arrow direction with the needle held in its lowered position (FIG. 4(D)). After the lower side of the free end portion of the flap 4 has been sewn on the zipper halfway in the longitudinal direction of the zipper while turning the flap over, the sewing machine 10 is once stopped and the slider 3*a* of the zipper 3 is moved retracted or back to substantially the central area of the length of the zipper 3 (FIG. 4(E)). Thereafter, the sewing operation is resumed to continue to sew the flap to a predetermined position in the longitudinal direction of the zipper whereupon thread cutting is effected to complete the sewing operation (FIG. 4(F)).

Since the sewing process is basically conducted manually by the operator, the process has the following drawbacks:

(I) The surface cloth and zipper (or lining) tend to displace relative to each other.

(II) The moving manipulation of the slider is troublesome.

(III) The formed seam or seams tend to be meandering.

(IV) The sewing width is not uniform.

(V) Safety in the sewing operation is not assured.

(VI) Highly skilled hand is required to obtain a final sewn product of high quality.

The present invention has been developed to eliminate the drawbacks inherent in the above-mentioned prior art and a first object of the present invention is to provide an automatic sewing machine exclusively used for sewing a zipper on a workpiece automatically and precisely.

Another object of the present invention is to provide a process for sewing a zipper on a workpiece safely and effectively by the use of an automatic sewing machine designed to exclusively carry out the process.

A further object of the present invention is to provide a cassette type zipper setting device adapted to be detachably attached to an automatic sewing machine exclusively used for sewing a zipper on a workpiece for temporally setting the zipper and the workpiece.

A further object of the present invention is to provide a flap turning-over device adapted to automatically turn the flap over when the lower side of the flap is sewn by the sewing machine.

A further object of the present invention is to provide the configuration of an intermediate holding-down member to cooperate with the above-mentioned flap turning-over device for acceleration of the flap turning-over as the lower side of the flap is sewn and for effectively holding a workpiece as the needle is pulled out of the workpiece.

DISCLOSURE OF THE INVENTION

A first aspect of the present invention resides in an automatic sewing machine exclusively used for sewing a zipper on a flapped workpiece and comprising:

a sewing machine capable of at least linearly sewing;

a drive device movable in two directions right angles to each other in a plane vertical to the movement direction of the sewing machine needle; and a zipper setting device attached to the above-mentioned drive device for holding the zipper and workpiece in a predetermined relationship to each other.

In a preferred embodiment of the invention, the zipper setting device is secured to the above-mentioned drive device and adapted to grip the zipper and workpiece by the operation of an air or pneumatic actuator or a solenoid.

In another preferred embodiment of the invention, the zipper setting device is detachably attached to the above-mentioned drive device. In this embodiment, the zipper and workpiece are held in position by a spring disposed in a predetermined position externally of the sewing machine.

In a further preferred embodiment of the invention, a zipper holding-down leaf spring is provided for positively holding the zipper (or lined zipper) in position.

A second aspect of the invention resides in a process for sewing a zipper on a flapped workpiece by the use of an automatic sewing machine exclusively designed for the purpose comprising the steps:

preparing a zipper having a length longer than a required length by the length of the slider thereof;

gripping the above-mentioned zipper and flapped workpiece with the slider projecting outwardly beyond one end edge of the workpiece;

moving the above-mentioned zipper and flapped workpiece in an L-shaped orientation to each other in a plane vertical to the movement direction of the sewing machine needle in response to the operation of the sewing machine while gripping the zipper and flapped workpiece to thereby sew the inner side edge of the flap in linearly longitudinal and transverse directions;

turning the flap over and moving the zipper and flapped workpiece substantially linearly relative to the sewing machine needle while holding the zipper and workpiece to thereby sew the lower side of the flap longitudinally linearly;

stopping the sewing machine and effecting thread cutting;

removing the workpiece having the zipper sewn thereon out of the sewing machine;

retracting the zipper to an intermediate position in the longitudinal direction of the zipper and then cutting off the portion of the fastener tapes projecting outwardly beyond one end edge of the sewn product; and fastening a stopper to the zipper in a predetermined position adjacent the leading end of the zipper.

The preferred mode of the process of the invention further includes the step of sewing the prepared zipper on the lining with the slider thereof projecting outwardly beyond one end edge of the lining and the above-mentioned gripping step consisting of gripping the zipper and surface cloth with the slider projecting outwardly beyond the aligned end edges of the lining and surface cloth.

Another preferred mode of the process of the invention includes the steps of gripping the zipper and workpiece by a cassette type zipper setting device which is separate from the sewing machine and of detachably attaching the setting device to support means movable in biaxial directions in a plane vertical to the movement direction of the sewing machine needle.

A third aspect of the invention resides in a cassette-type zipper setting device detachably attached to a drive device relatively movable in biaxial directions in a plane vertical to the movement direction of the sewing machine needle and comprising:

a platform including an attachment portion adapted to be detachably attached to the above-mentioned sewing machine drive device and an opening through which the sewing machine needle can pass;

a zipper holding-down member provided adjacent the above-mentioned opening in the platform for detachably holding a zipper in alignment with a predetermined position on the above-mentioned platform; and a workpiece holding-down mechanism provided on the above-mentioned platform for removably holding the workpiece in a predetermined position relative to the zipper.

In the preferred embodiment described just above, the above-mentioned attachment portion of the platform comprises a pair of side edges adapted to slide into guide grooves formed in the above-mentioned support means.

In another preferred embodiment of the invention the above-mentioned zipper holding-down member comprise a pair of holding-down leaf springs in the form of ski plate provided on the opposite sides of the opening in the platform.

In a further embodiment of the invention, the above-mentioned workpiece holding-down mechanism is designed to independently hold the workpiece on the opposite sides of the opening in the platform. The workpiece holding-down mechanism further comprises a lever securing plate secured to the above-mentioned platform and having a slot, a workpiece holding-down plate rockably attached to the above-mentioned platform, a lever rockably attached to the above-mentioned platform in coaxial with the above-mentioned workpiece holding-down plate and a projection adapted to enter the above-mentioned slot in the lever securing plate to hold the workpiece holding-down plate and a spring acting between the above-mentioned workpiece holding-down plate and lever to urge them away from each other.

A fourth aspect of the invention resides in a flap turning-over device adapted to automatically turn the flap over as the sewing machine sews the lower side of the flap comprising:

a signal producing device adapted to signal when the sewing operation on the sewing machine has proceeded to the step for sewing the lower side of the flap;

a flap-turning-over member adapted to contact the flap to turn the flap over; and a drive mechanism adapted to cause the above-mentioned flap-turning-over member to move vertically in response to a signal from the signal producing device.

In the preferred embodiment of the invention described just above, the drive mechanism comprises a first actuator for moving the above-mentioned flap-turning-over member vertically and a second actuator for moving the flap-turning-over member horizontally. In this embodiment, the flap-turning-over member first moves vertically and then horizontally in a direction to turn the flap over when the lower end of the flap-turning-over member is positioned below the free end of the flap in a further preferred embodiment of the invention, the flap-turning-over member is designed to effect a curved, elliptical, circular or parabolic movement.

A fifth embodiment of the invention resides in an intermediate holding-down member having a certain thickness in the shape of a ship and the longer axis extending in the advance movement direction of the workpiece for positively holding the workpiece down as the sewing needle clears the workpiece when the sewing machine sews the lower side of the flap and comprising:

a needle receiving through slot formed substantially in the center of the member and having the longer axis extending in the longer axis direction of the above-mentioned slot;

a leading end portion for deflecting the flap towards the left-hand side or right-hand side of the intermediate holding-down member; and flap guides formed on the opposite sides of the intermediate holding-down member for assisting the turning-over of the flap deflected towards the left-hand or right-hand side of the member.

BRIEF DESCRIPTION OF THE DRAWINGS

FIG. 1 is a schematic plan view showing two different forms of flaps;

FIGS. 2(A) and (B) are exploded perspective and right-hand side elevational views, respectively, showing relative relationship between components of a workpiece without a lining;

FIGS. 3(A) and (B) are exploded perspective views showing relative relationship between components of a lined workpiece;

FIG. 11 is a block diagram of the pneumatic circuit of the flap turning-over device as shown in FIG. 10;

FIG. 12 is a schematic view explaining the operation of the flap turning-over device of FIG. 10;

DESCRIPTION OF PREFERRED EMBODIMENTS

Figure 4A:
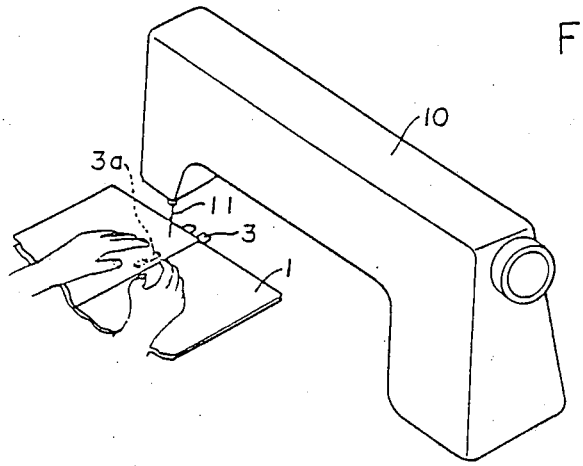
FIGS. 4(A)-(F) are schematic views showing the conventional sewing process.
Figure 4B:
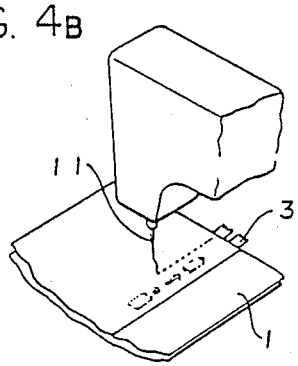
Figure 4C:
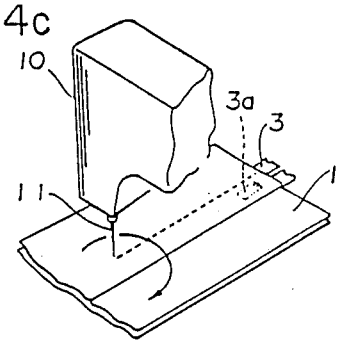
Figure 4D:
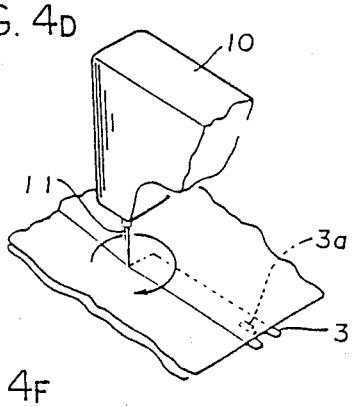
Figure 4E:
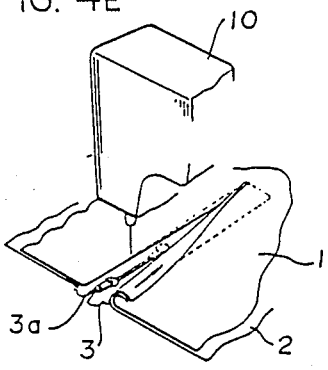
Figure 4F:
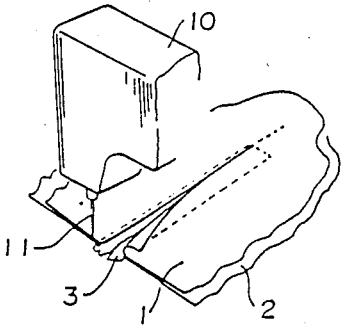
Figure 5:
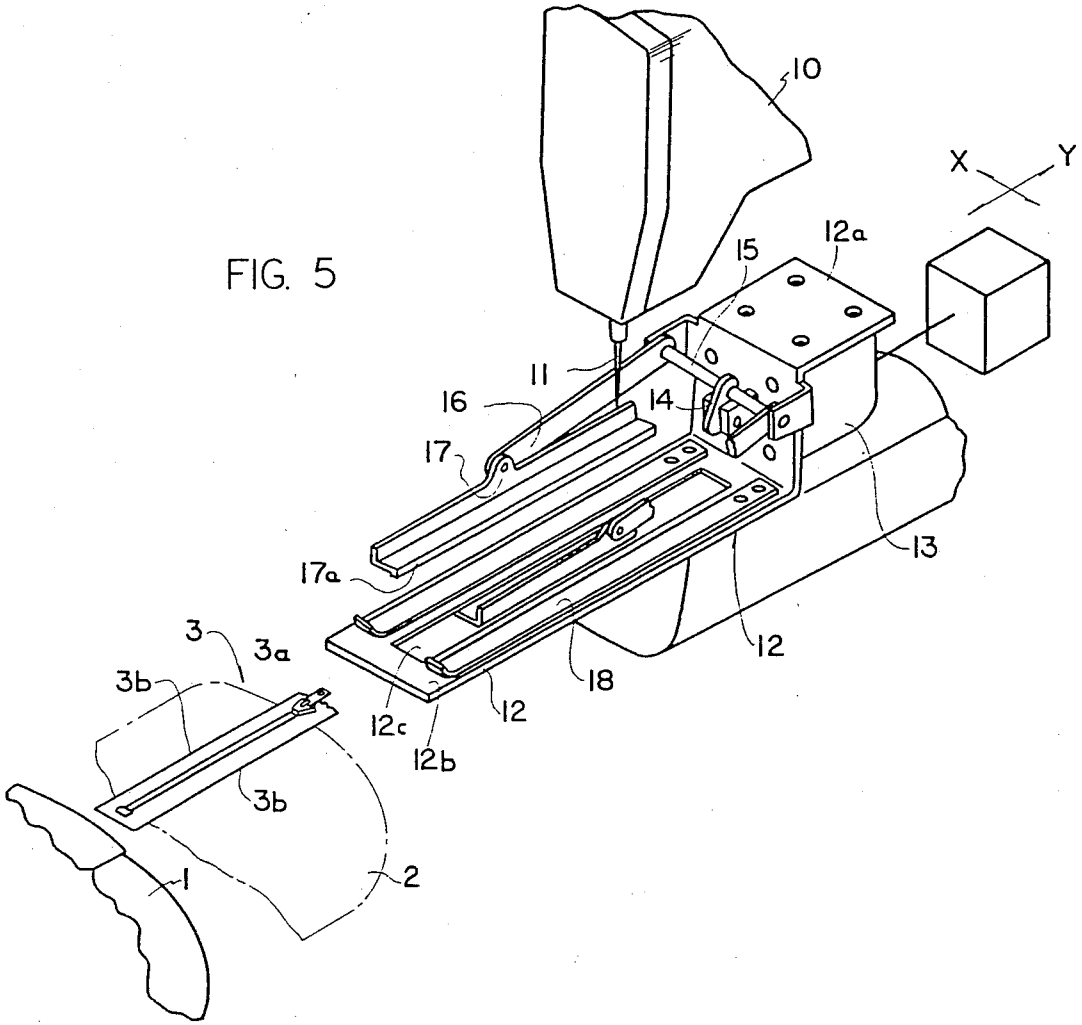
FIG. 5 is a perspective view of the principal parts of one embodiment of the automatic sewing machine exclusively used for sewing a zipper on a workpiece according to the present invention.

Referring to FIG. 5, there is shown principal parts of the automatic sewing machine exclusively used for sewing a zipper on a workpiece in a perspective view.

Figure 6:
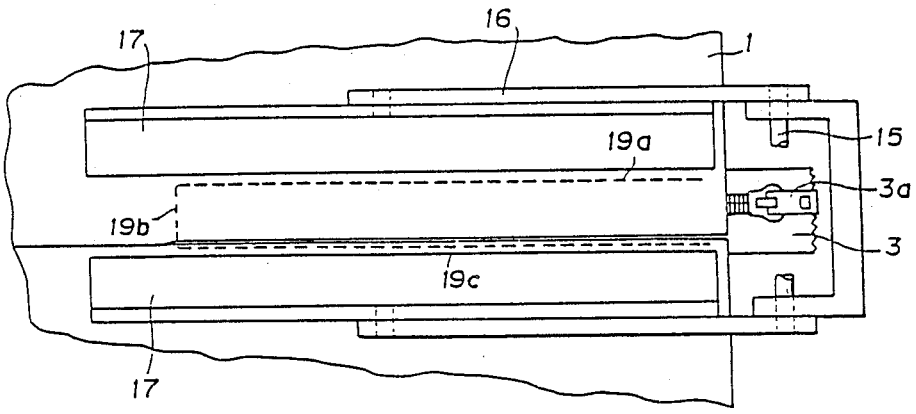
FIGS. 6 and 7 are plan and front elevational views, respectively, of the principal parts of the sewing machine of FIG. 5 showing them after the zipper has been sewn on the workpiece.
Figure 10:
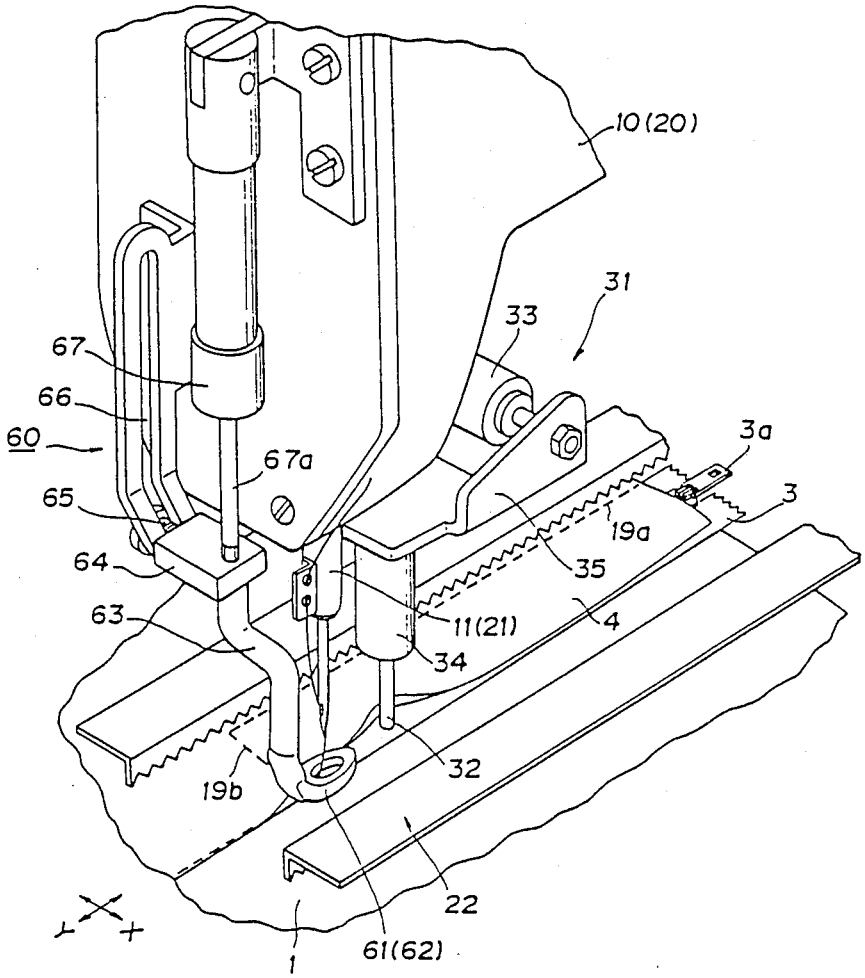
FIG. 10 is a detailed perspective view of the head of the automatic sewing machine exclusively employed in the automatic sewing machine according to the present invention.

The sewing machine 10 is a conventional sewing machine which is capable of at least linearly sewing as shown by the broken line in the plan view of FIG. 6. An X - Y axis drive device (not shown) is attached to the sewing machine and drives the arm 13 in the X - Y axes right angles to each other in a plane vertical to the movement direction of the sewing machine needle 11. A zipper setting device 12 is detachably or fixedly attached by means of its attachment portion 12*a* to the arm 13 of the X - Y axis drive device. The zipper setting device 12 also comprises a platform 12*b* supporting a workpiece, for example, the surface cloth 1 of a skirt. Provided in the platform 12*b* at substantially the central area thereof is a through opening 12*c* through which the sewing machine needle 11 passes. The platform 12*b* of the zipper setting device 12 is provided with a pair of holding-down members 18 along the opposite sides of the opening 12*c*. In the illustrated embodiment, the zipper holding-down members are formed of a pair of holding-down leaf springs in the shape of a ski plate secured at the inner ends thereof to the platform 12*b*. It will be apparent to those skilled in the art that the same purpose can be attained by various other arrangements. The zipper setting device 12 is also provided with a pair of holding-down plates 17 urged against the zipper holding-down members 18 through a shaft 15 fixedly secured to a link 14 and rotatably journalled on the platform 12*b* for rotation with respect to the platform 12*b* and a pair of levers 16 fixedly secured to the opposite ends of the shaft against rotation. The above-mentioned surface cloth 1 of the skirt is placed onto the zipper holding-down members 18 after the zipper 3 having the lining 2 sewn thereto or without the lining been sandwiched between the platform 12*b* and zipper holding-down members 18. Thus, when the actuator or solenoid is energized, the surface cloth 1 is positively held between the zipper holding-down members 18 and holding-down plates 17. In order that the surface cloth 1 and zipper 3 will not displace relative to each other during the sewing operation, various arrangements are provided. For example, the inner side edge 17*a* of the holding-down plate 17 may be bent downwardly by a small amount (FIG. 5), the surface of the holding-down plate which comes to contact the surface cloth may be applied thereto a slip-resistance tape made of rubber or the like or the undersurface of the downwardly bent inner side edge of the holding-down plate may be knurled (FIG. 10). After the zipper 3 and surface cloth 1 have been positively held in the zipper setting device in the manner mentioned just above, the sewing machine 10 and X - Y axis drive device are driven to sew the zipper on the surface cloth.

Figure 7:
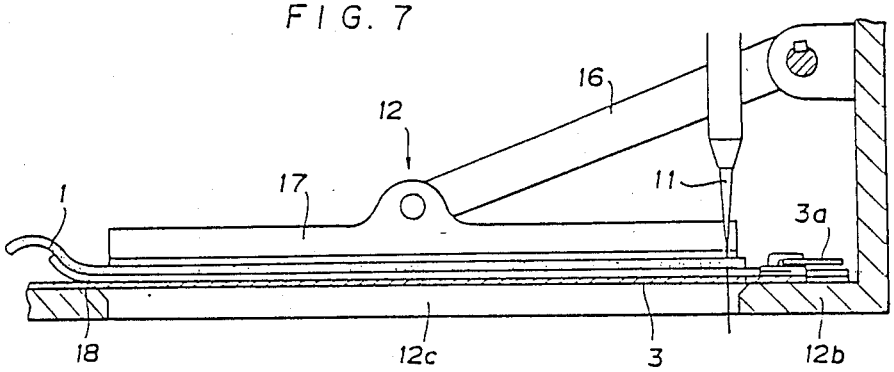

The zipper sewing-on process according to the present invention includes the step in which the zipper 3 having a length longer than a required length by an amount corresponding to the length of the slider 3*a* thereof and the surface cloth 1 of a workpiece such as a skirt, for example, are held down by the above-mentioned zipper setting device 12 or the like with the slider projecting outwardly beyond the end of the surface cloth. With the zipper and surface cloth positively held down by the zipper setting device, the sewing machine 10 is operated and the surface cloth and zipper are moved relative to each other so as to describe an L-shape in a plane vertical to the movement direction of the sewing needle 11 to thereby form a longitudinal straight seam 19*a* along the inner side edge of the flap and a transverse straight seam 19*b* (see FIG. 6). The sewing-on process of the present invention includes the step in which a longitudinal straight seam 19*c* is formed along the lower side of the free side edge of the flap by moving the flap in parallel to the seam 19*a* while turning the flap over with the zipper 3 and skirt surface cloth 1 positively held against movement. After the sewing machine 10 has been once stopped and thread cutting has been effected, the skirt having the zipper sewn thereon is removed out of the sewing machine. Thereafter, the slider 3*a* is retracted halfway in the longitudinal direction of the zipper 3, the portion of the fastener tapes 3*b* projecting outwardly beyond the end of the skirt is cut off and a stopper is fastened to the zipper in a predetermined position thereof to thereby complete the zipper having a proper length. According to the zipper sewing-on process of the present invention, since the slider 3*a* is not present at the area where the needle 11 of the machine 10 passes while the zipper 3 is being sewn on the skirt in this way, interference between the slider 3*a* and needle 11 can be perfectly avoided. FIG. 7 shows the condition immediately after the completion of sewing of the zipper 3 on the surface cloth 1 by the sewing machine needle.

Figure 8:
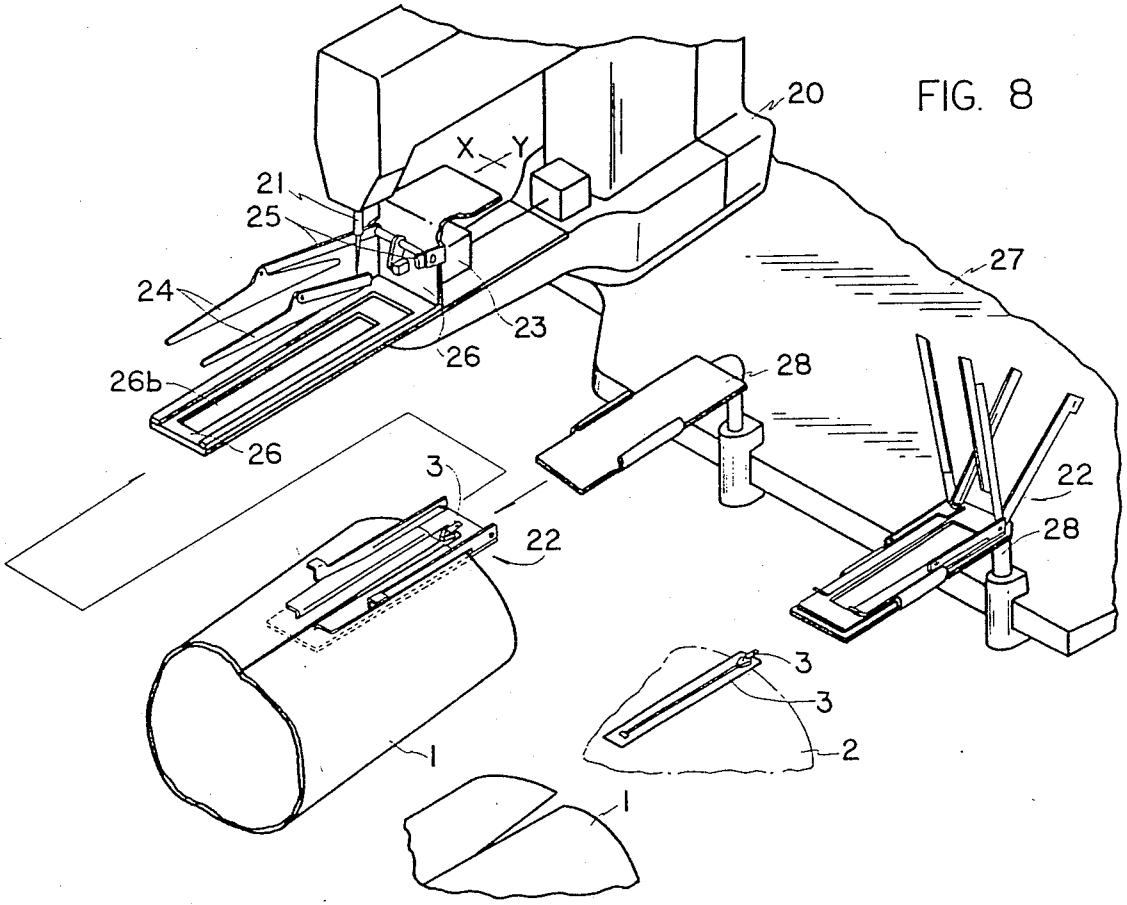
FIG. 8 is a perspective view of another embodiment of the automatic sewing machine exclusively used for sewing a zipper on a workpiece according to the present invention.

FIG. 8 shows another embodiment of the automatic sewing machine exclusively used for sewing a zipper on a workpiece according to the present invention. The sewing machine 20 of this embodiment is identical with the sewing machine 10 shown in FIG. 5 with respect to fundamental structure. That is, the arm 23 of the X - Y axis drive device (not shown) attached to the sewing machine 20 is designed to freely drive support means 26 in a plane vertical to the movement direction of the needle 21 which support means is designed to support the detachable cassette type zipper setting device 22. The support means 26 comprises a pair of opposing guide grooves 26*a* into which the zipper setting device 22 slides to be held in a predetermined position and an opening 26*b* through which the sewing machine needle 21*a* can pass. As in the case of the sewing machine 10 of FIG. 5, the support means 26 also comprises a linkage 25 and holding-down plates 24 for positively holding the zipper setting device 22 received in the support means in position.

Figure 9:
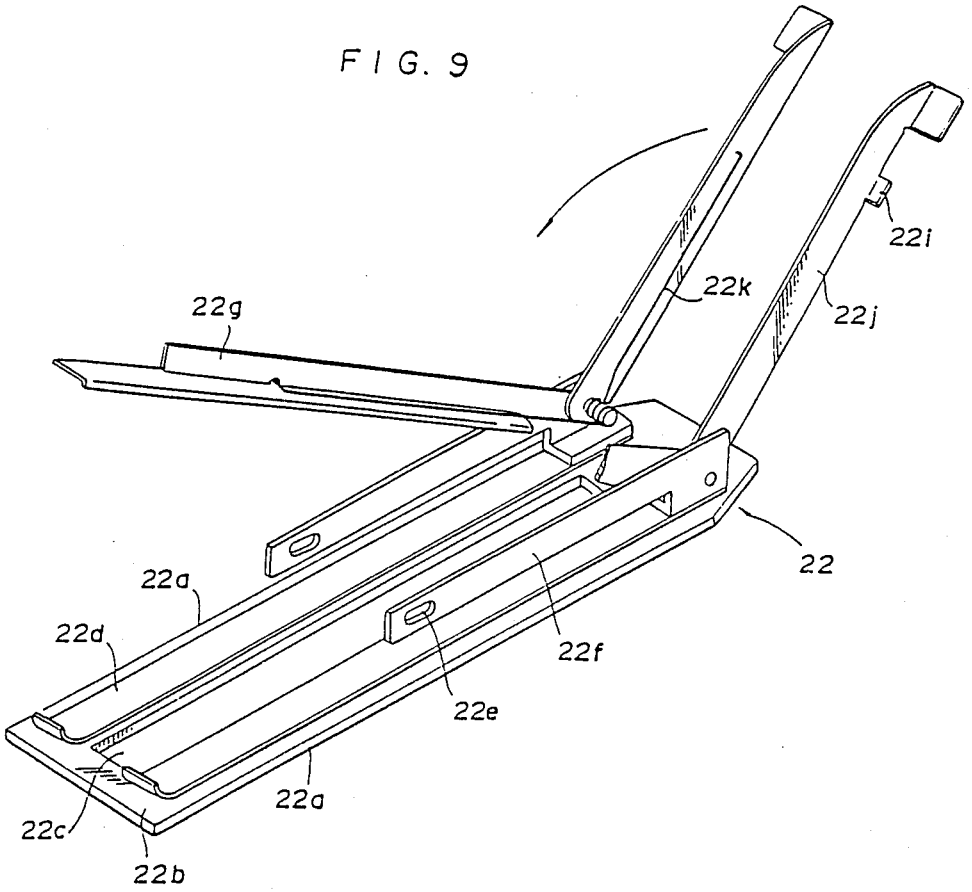
FIG. 9 is a perspective view of the cassette type zipper setting device employed in the automatic sewing machine of FIG. 8.

Details of the cassette type zipper setting device 22 are shown in FIG. 9. The zipper setting device 22 includes a platform 22*b* having side edges 22*a* adapted to be received in the pair of guide grooves 26*a* in the support means 26 driven by the X - Y axis drive device. Formed in the platform 22*b* in the position in alignment with the opening 26*b* in the support means 26 is an opening 22*c*. Zipper holding-down members 22*d* are fixedly secured to the platform 22*b* and have the same construction as the zipper holding-down members 18 shown in FIG. 5. The zipper setting device 22 further comprises workpiece holding-down mechanisms adapted to removably hold the surface cloth 1 of a workpiece such as a skirt, for example, on the platform 22*b* in a predetermined position with respect to the zipper 3. In the illustrated embodiment, the right-hand and left-hand side workpiece holding-down mechanisms operate independently of each other. The workpiece holding-down mechanism comprises a lever securing plate 22*f* fixedly secured to the inner end of the platform 22*b* and having a slot 22*e*, a holding-down plate 22*g* attached to the platform 22*b* for rocking movement relative to the platform, a lever 22*j* attached to the platform 22*b* in coaxial with the holding-down plate 22*g* for rocking movement relative to the platform and having a projection 22*i* adapted to enter the slot 22*e* in the lever securing plate 22*f* to hold the holding-down plate 22*g* in a predetermined position and a coil spring 22*k* mounted to bias the holding-down plate 22*g* and lever 22*j* away from each other.

When the sewing machine 20 having the detachable zipper setting device 22 which is the second embodiment of the present invention is employed, the sewing-on process as described hereinabove further includes the step in which the zipper 3 with or without the lining 2 and the skirt surface cloth 1 are positively held in position in the zipper setting device 22 by the use of a platform 28 fixedly secured to a table 27 positioned externally of the sewing machine, for example and the zipper setting device 22 having the zipper and surface cloth held therein is then detachably attached to the support means 26.

The process makes it possible to preliminarily hold the zipper 3 and surface cloth 1 using the platform 28 during the sewing operation of the sewing machine 20 and replace the zipper setting device 22 upon the completion of the sewing operation to thereby substantially enhance operation efficiency. And when zipper setting devices 22 having a plurality of parts of different sizes are in stock, the sewing machine can easily accommodate different sewing operations. And since the second embodiment of the sewing machine is different from the sewing machine 10 of FIG. 5 in which the zipper 3 an surface cloth 1 are directly held in the machine, the second embodiment of the sewing machine has the advantage that the zipper and surface cloth will not substantially get out of position relative to each other and/or bend and thus, the obtained product has a high quality.

Referring to FIG. 10, there are shown a flap turning-over device 31 adapted to automatically turn the flap 4 over when the lower side of the free side edge of the skirt flap 4, for example, is sewn and an intermediate holding-down and drive mechanism having an intermediate pressure foot 61 adapted to positively hold the skirt surface cloth 1 down when the needle clears the surface cloth and assist the turning-over of the flap and having a thick substantially ship-shape and the longer axis extending in the advancing direction of the skirt.

FIG. 11 shows the air pressure circuit for the flap turning-over device 31 and FIGS. 12(A)-(C) schematically show the operation of the flap turning-over device 31. The illustrated flap turning-over device 31 comprises a first cylinder 33 for moving a flap turning-over portion 32 in the X axis direction as shown, a second cylinder 34 for moving the flap turning-over portion 32 vertically and a connector plate 35 connecting between the two cylinders. In the illustrated air pressure circuit, 36 is a five-port and two-position change-over valve, 37 is a three-port and two-position change-over valve, 38 is a flow regulator valve with a check valve and 39 is an air pressure supply source.

When the five-port and two-position change-over valve 36 is shifted from the position of FIG. 11 to the upper circuit, compressed air from the air pressure supply source 39 flows via a line 40 and its branch line 40*a* into the three-port and two-position change-over valve 37 and further through a line 42 into the cylinder chamber of the second cylinder 34. Thus, the flap turning-over portion 32 is lowered (FIG. 12(A)), but when the flap turning-over portion 32 reaches the bottom dead point (FIG. 12(B)), pressure rises in the lines 40*a*, 40*b* and 42. When the pressure exceeds a predetermined set value, the compressed air flows through the flow regulator valve 38 with a check valve into the line 40 and is supplied into the first cylinder chamber 33*a* of the first cylinder 33 whereby the connector plate 35 secured to the piston rod associated with the first cylinder 33 and accordingly, the second cylinder 34 secured to the connector plate and the flap turning-over portion 32 move leftwards as shown in FIG. 11 and the flap turning-over portions 32 turns the flap 42 over.

When the five-port and two-position change-over valve 36 is shifted to the lower circuit and simultaneously, the three-port and two-position change-over valve 37 is shifted to the lower circuit, compressed air supplied into the line 41 flows through the line 41*a*, change-over valve 37 and line 42 into the second cylinder 34 and then through the line 41*b*, flow regulator valve 38 and line 41*c* into the second chamber 33*b* of the first cylinder 33 whereby the flap turning-over portion 32 moves rightwards as shown in FIG. 11 at its bottom dead point. Finally, when the three-port and two-position change-over valve 37 is shifted to its upper circuit, the line 42 is evacuated through the lines 40*a*, 40 and five-port and two-position change-over valve 36 and in fluid communication resulting in rapid reduction in air pressure. Thus, the piston rod in the second cylinder 34 is raised under spring pressure and accordingly, the flap turning-over portion 32 is caused to rise.

Figure 13A:
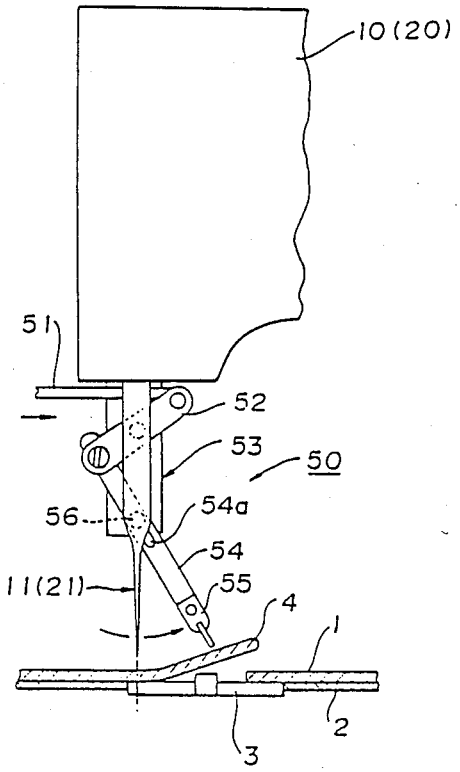
FIG. 13 is a schematic front elevational view for explaining the operation of another embodiment of the flap turning-over device.
Figure 13B:
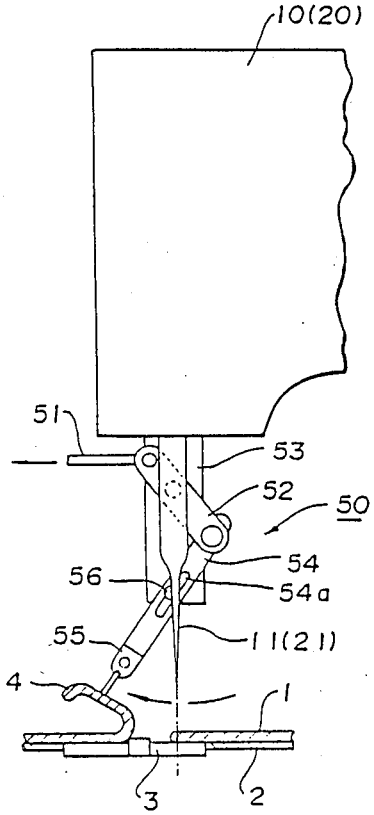

FIG. 13 is a side elevational view of another embodiment of the flap turning-over device.

In FIG. 13, 50 is a flap turning-over device, 51 is an air pressure actuator or solenoid operated operation rod attached to the sewing machine 10 (20), 52 is a first drive lever pivoted at one end to the operation rod 51 and rockably journalled in a support member 53 suspended from the head of the sewing machine, 54 is a second drive lever pivoted at one end to the other end of the first drive lever 52 and 55 is a flap turning-over portion attached to the other end of the second drive lever 54. The second drive lever 54 has a slot 54*a* at substantially the central area thereof for receiving a stub shaft 56 provided on the support member 53 right below and in parallel to the shaft of the first drive lever 52. Thus, the second drive lever 54 can rock about the stub shaft 56 while sliding on the stub shaft. Thus, the lower end of the flap turning-over portion 55 secured to the other end of the second drive lever 54 moves elliptically as the operation rod moves reciprocally.

And the flap turning-over device may be of various arrangements such as those in which the lower end of the flap turning-over portion moves circularly or parabolically other than the illustrated one.

Figure 14A:
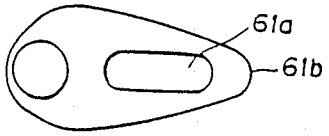
FIGS. 14(A)-(C) are plan, front elevational and right-hand side elevational views, respectively, of the intermediate holding-down member as shown in FIG. 10.
Figure 14B:
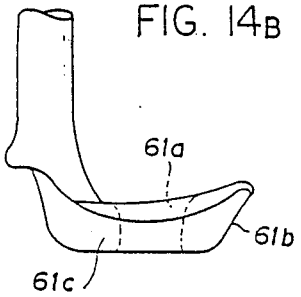
Figure 14C:
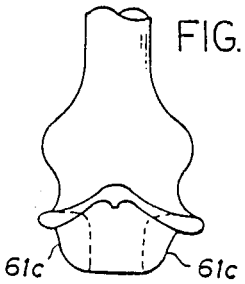

FIGS. 14(A)–(C) are plan, front elevational and right-hand side elevational views, respectively, of the intermediate pressure foot 61 shown in FIG. 10. The intermediate pressure foot 61 comprises a slot 61*a*, a leading end portion 61*b* adapted to deflect the flap towards the right-hand or left-hand side of the intermediate pressure foot 61 and flap guides 61*c* formed in the opposite sides of the intermediate pressure foot for turning the deflected flap over. The needle 11 (21) of the sewing machine 10 (20) can extend through the slot 61*a* in the intermediate pressure foot 61. When the longitudinal straight seam 19*a* and the transverse straight seam 19*b* are formed on the flap as shown in FIG. 6, like the conventional pressure foot, the inventive intermediate pressure foot 61 acts to hold a workpiece so that when the needle 11 clears the workpiece, the workpiece will not be lifted due to its frictional resistance to the needle 11 and thus will not interfere with the formation of the seams. On the other hand, when the seam 19*c* is formed on the lower side of the free side edge of the flap 4, as shown in FIG. 10, the sewing machine sews the zipper 3 and the workpiece together while the flap turning-over device 31 (50) is turning the flap 4 over. At this time, the intermediate pressure foot 61 guides the end edge of the flap turned over by the flap turning-over device along the flap guides 61*c* so as to prevent the flap 4 from turning back onto the zipper 3 while the sewing operation.

Figure 15:
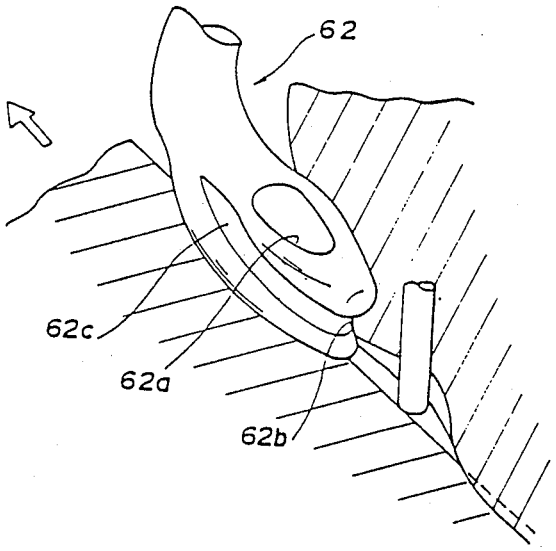
FIG. 15 is a perspective view of another embodiment of the intermediate holding-down member.
Figure 16A:
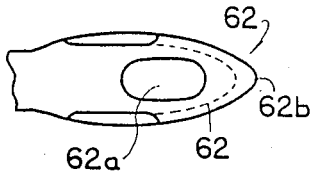
FIGS. 16(A)-(D) are plan, front elevational, right-hand side elevational views, respectively, of the intermediate holding-down member of FIG. 15 and a vertically cross-sectional view taken along the line D—D of FIG. 16(B)
Figure 16D:
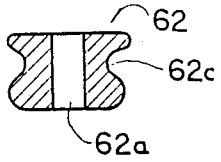
Figure 16B:
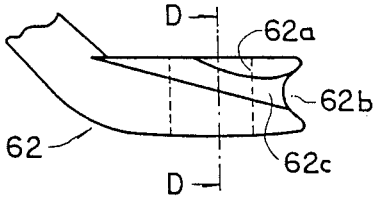

FIG. 15 is a perspective view of another embodiment of the intermediate pressure foot, FIGS. 16(A)–(D) are plan, front elevational, right-hand side elevational views, respectively, of the intermediate pressure foot and a longitudinally sectional view taken along the line D—D of FIG. 16(B).

Figure 16C:
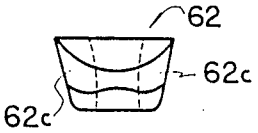

The intermediate pressure foot 62 has a substantially elliptical shape and comprises a slot 62*a*, a leading end portion 62*b* and flap guides 62*c* formed in the opposite sides of the pressure foot. As shown in FIG. 16(C), the flap guide 62*c* has a groove-shaped cross section and slopes upwardly by a small degree towards the rear of the pressure foot. Thus, the turning-over of the flap is accelerated.

Now, the intermediate pressure foot drive mechanism 10 for driving the above-mentioned pressure foot 61 (62) will be described referring to FIG. 10. 67 is a cylinder pivoted at one end to the head of the sewing machine 10 and the piston rod 67*a* of the cylinder supports an intermediate pressure bar 63 having the intermediate pressure foot 61 (62) at the lower end of the bar through a platform 64. 66 is a cam member secured to the head of the sewing machine and having a cam groove 66*a* for guiding a guide shaft 65 secured to one end face of the platform 64. The cam groove has such a shape that as the piston rod 76*a* of the cylinder 67 moves downwardly, the intermediate pressure foot 61 (62) moves out of the movement path of the needle 11 (21) and moves down from a position above and spaced from the upper surface of the sewing machine bed without being obstructed by the needle 11 (21) until the slot 61*a* (62*a*) in the pressure foot 61 (62) comes to the position opposite to the movement path of the needle 11 (21) whereupon the pressure foot 61 (62) presses the workpiece against the upper surface of the bed and as the above-mentioned piston rod 76*a* moves down, the intermediate pressure foot 61 (62) displaces laterally of the movement path of the needle 11 (21) in the direction opposite from that described above so as not to interfere with the needle and moves upwardly. Thus, in the lowered position, the intermediate pressure foot 61 (21) functions as an auxiliary device for the workpiece holding-down device and flap turning-over device and when the intermediate pressure foot moves back or upwardly after the operation of the thread cutter device, the intermediate pressure foot functions as a wiper device.

Now, the electrical control function will be described referring to FIGS. 17, 18 and 19.

Figure 17:
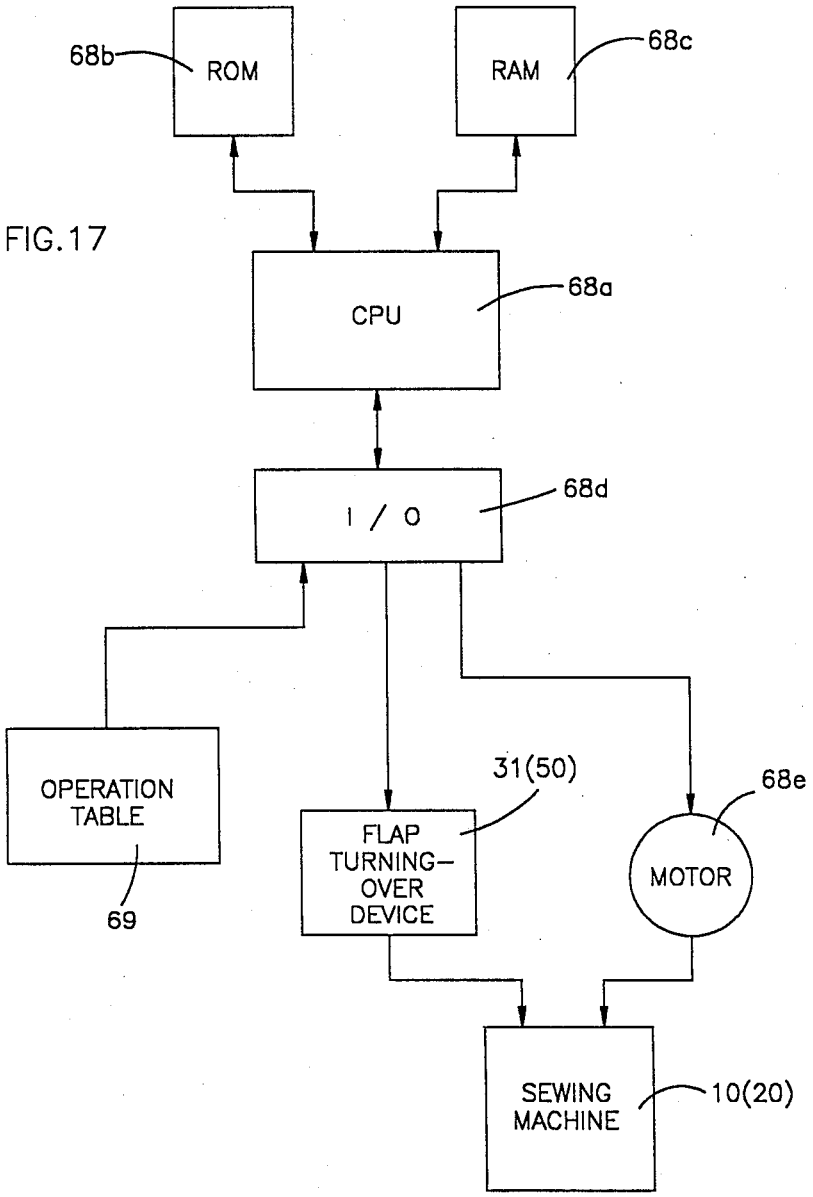
FIG. 17 is a schematic block diagram of the essential portion of the hardware.

FIG. 17 shows the block diagram of essential components of one embodiment of the present invention. That is, ROM (read only memory) 68*b* and RAM (random access memory) 68*c* are connected to a control circuit 68*a*. And an operation table 69 is also connected to the control circuit 68*a* through an I/O circuit (input/output circuit) 68*d*. Furthermore, the output of the control circuit 68*a* is connected through the I/O circuit 68*d* to a motor 68*e* adapted to move the pressure foot based on a sewing pattern and to the above-mentioned flap turning-over device 31 (50) (FIGS. 10–13) and the outputs of the motor and flap turning-over device are connected to the above-mentioned sewing machine 10 (20).

Figure 18:
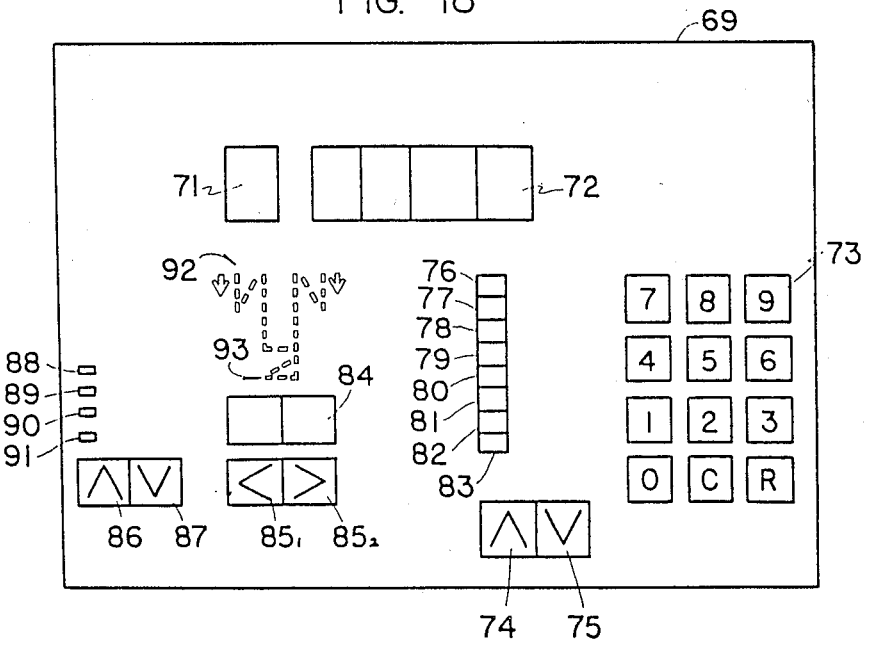
FIG. 18 is a schematic view of the operation table.

FIG. 18 shows details of the above-mentioned operation table 69. The operation table 69 comprises display means 71, 72, a data input key group 73, switches 74, 75 for changing-over input data mode, lamps 76–83 formed of LED for displaying input data mode, a switch 84 for inputting presence and absence of transverse seam, switches $85_1$, $85_2$ for inputting sewing start position, switches 86, 87 for selecting sewing pitch input data and lamps 88–91 formed of LED for displaying sewing pitch to be input.

Figure 19A:
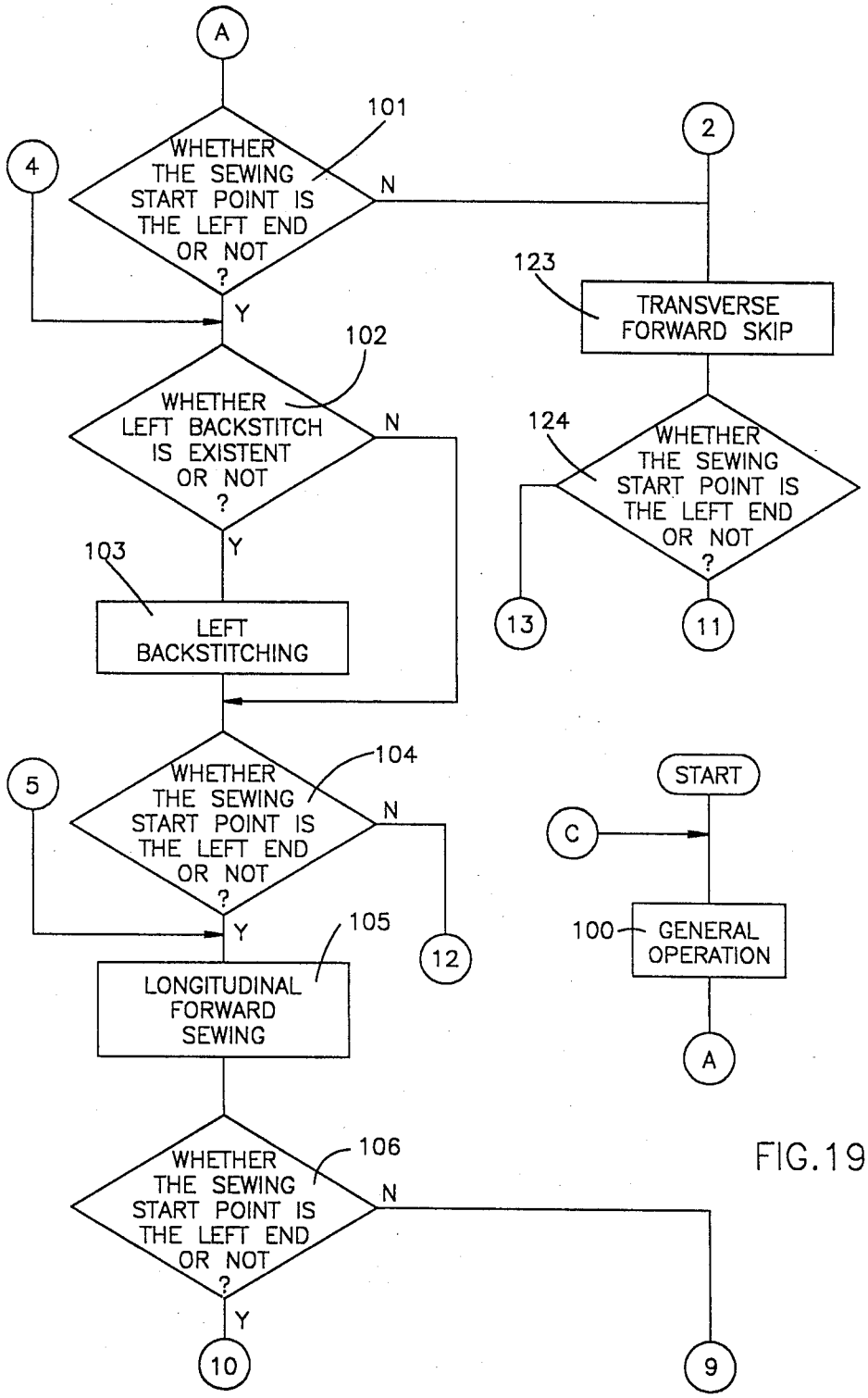
FIG. 19 is a flow chart showing the operation of the automatic sewing machine exclusively used for sewing a zipper on a workpiece according to the present invention.
Figure 19B:
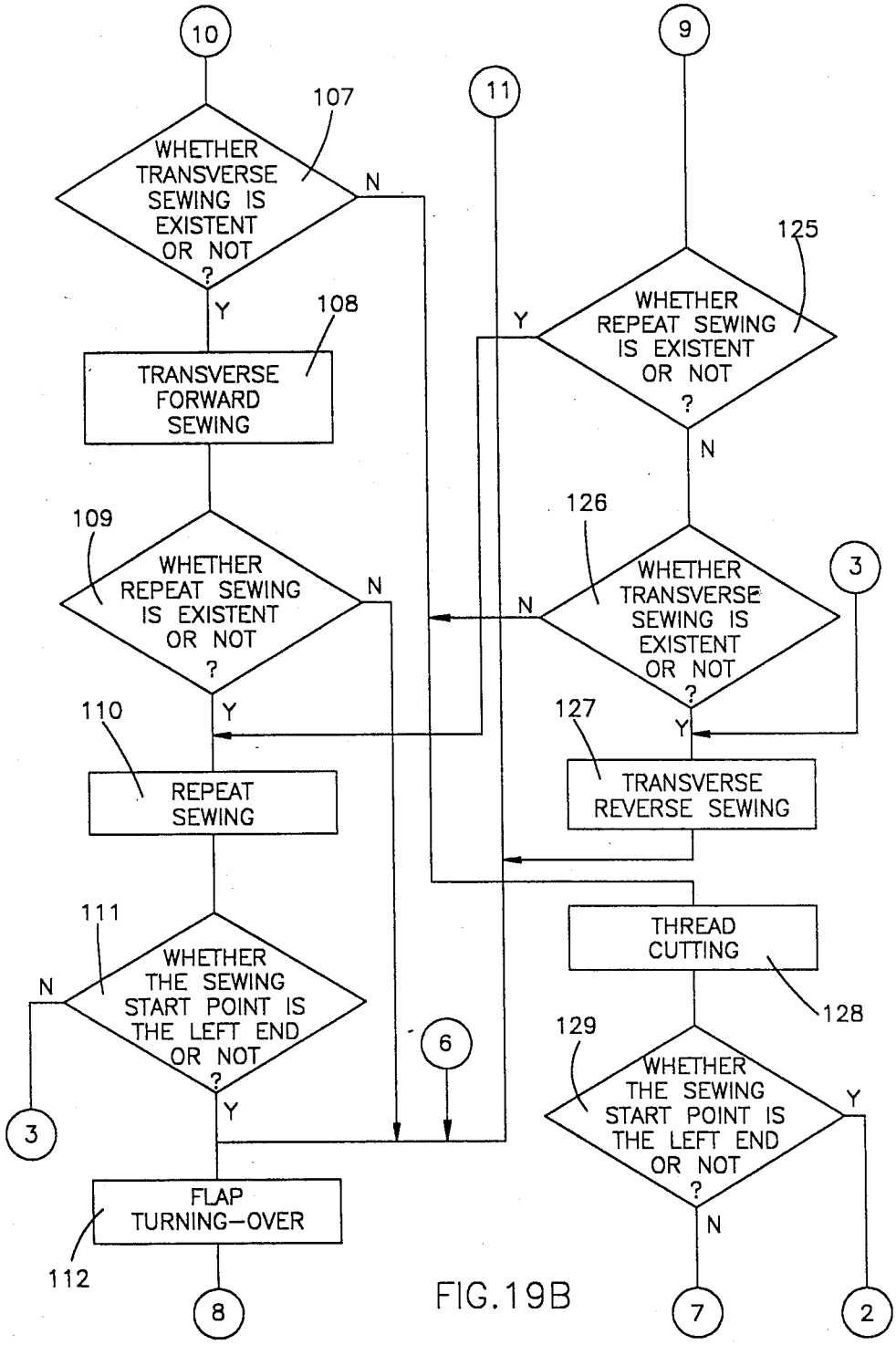
Figure 19C:
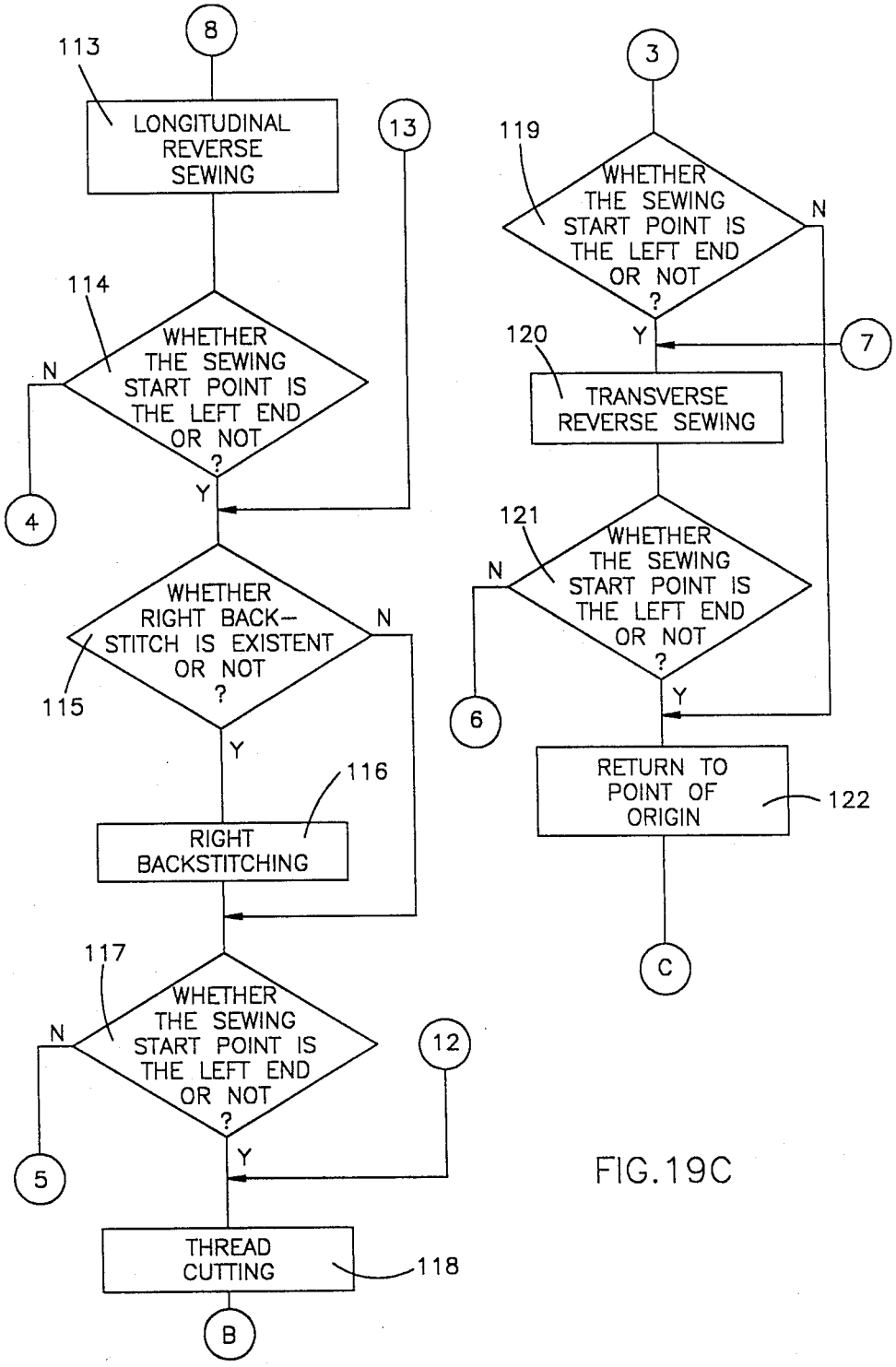

FIG. 19 shows the flow chart of the control program for the sewing machine of the present invention stored in the above-mentioned ROM 62. FIG. 19 shows the instance in which the left-hand end of the sewing pattern is the point of origin (reference point).

With the above-mentioned arrangement, sewing pattern data are stored in RAM 86*c* by the operation table 69. First of all, the type of data to be input by the switches 74, 75 is selected. This is performed by lighting the lamps 76–83 in succession from the lowermost lamp to the uppermost lamp by the switch 74 and lighting the lamps 76–83 in succession from the uppermost lamp to the lowermost lamp by the switch 75 so as to light the lamp or lamps corresponding to data to be input.

First of all, "pattern input" is selected and pattern No. is input by the data input key group 73. The pattern No. is displayed on the display circuit 71. After the inputting of the pattern No., "longitudinal direction length" is selected and the longitudinal direction length of the sewing pattern 92 (which is referred to merely as "longitudinal length" hereinafter) is input by the data input key group 73. The longitudinal length is displayed on the display circuit 72. And "transverse direction length" is selected and the transverse direction length of the sewing pattern 92 (which will be referred to merely as "transverse length" hereinafter) is similarly input. The transverse length is displayed on the display circuit 72.

When the right and left ends of the sewing pattern 92 are backstitched, "right backstitch amount" or "left backstitch amount" is selected and the number of backstitches is input by the data input key group 73. And when the transverse direction 93 of the sewing pattern is sewn, the switch 84 inputs transverse sewing "existence". And when the transverse direction 93 of the sewing pattern 92 is not sewn, the switch 84 inputs transverse sewing "absence". Furthermore, when the transverse direction 93 is repeatedly sewn, the switch 84 inputs transverse sewing "presence" again.

And when the sewing pattern 92 is sewn from the left end thereof, the switch $85_1$ inputs and when the sewing pattern 92 is sewn from the right end thereof, the switch $85_2$ inputs.

And the switches 86, 87 input sewing pitch data. This is performed by selectively lighting the lamps 8814 91 corresponding to sewing pitch to be input.

The above-mentioned input sewing pattern data are in succession written into RAM by the control circuit 61 to be memorized therein.

When the zipper 3 is sewn on the workpiece with the flap as shown in FIGS. 1(A), (B) and (C), respectively, the flap may be the right flap (FIG. 1(A)), the left flap (FIG. 1(B)) or the center flap (FIG. 1(C)). When the zipper is sewn on the three types of flaps, respectively, in the conventional sewing pattern automatic sewing machines, any one of the following four sewing patterns is required to be prepared and input. That is, (1) for the right flap, the sewing start point is the right end of the slider 3*a* on the zipper 3 (FIG. 2(B)) and the sewing machine sews in the longitudinal direction from the sewing start point and then in the transverse direction and finally in the longitudinal direction with the left end of the slider 3*a* as the sewing termination point. This is the first sewing pattern. (2) for the left flap, the sewing start point is the left end of the slider 3*a* and the sewing machine sews in the longitudinal direction from the sewing start point, then in the transverse direction and finally in the longitudinal direction with the right end of the slider 3*a* as the sewing termination point. This is the second sewing pattern. (3) for the center flap, the sewing start point is the left or right end of the slider 3*a* and the sewing machine sews in the longitudinal direction from the sewing start point, skips the transverse direction of the sewing pattern and then sews in the longitudinal direction with the left or right end of the slider 3*a* as the sewing termination point. This is concurrently the third and fourth sewing pattern.

However, in the sewing machine of the present invention, the above-mentioned four different sewing patterns are not required to be prepared, but it is only required to determine the configuration of the sewing pattern (longitudinal and transverse lengths) and input the sewing pattern together with the sewing start position and transverse sewing existence and absence. That is, it is only required that for the left flap, the left end sewing start position and transverse sewing existence and absence are input, for the right flap, the right end sewing start position and transverse sewing presence are input and for the center flap, the left or right sewing start position are input. This is one of the features of the present invention.

After data on the sewing pattern 92 have been prepared and input by the above-mentioned procedure, when pattern number is designated and the actuation switch inputs the pattern number, the sewing pattern is automatically sewn in accordance with the flow chart of FIG. 19 under control of the control circuit 68*a*. That is, after the point of origin processing and the general operation for converting input data into a sewing pattern or the like (Block 100 in FIG. 19 which will be referred to merely as "Block" hereinafter), the characteristic action of the present invention is attained.

First of all, description will be made of the instance in which the sewing pattern for the left flap is input. The control circuit 68*a* determines the sewing start position is at the left end or not (Block 101). For the left flap, the sewing start position is at the left end. Next, the existence or absence of a backstitch at the sewing start point is determined, and when the backstitch existence is input, left backstitch process is performed by the motor 68*a* and sewing machine 10 (20) based on the input data (backstitch amount data ) (Blocks 102, 103). Since the sewing start position is the left end, the motor 68*e* is then rotated in the forward direction based on longitudinal length data and the sewing machine 10 (20) sews the left hand side longitudinal length to sew the left flap on (Blocks 104, 105). Next, a transverse direction sewing is performed by the motor 68*e* and sewing machine 10 (20) (Blocks 106, 107, 108) based on transverse length data. When repeat sewing data are input, the motor 68*e* is rotated in the reverse direction and then the forward direction based on transverse length data and repeat sewing is performed (Blocks 109, 110). Next, right-hand side longitudinal sewing which is concealed by the left flap is performed by the sewing machine 10 (20) based on longitudinal length data (Blocks 111, 112, 113) when the flap turning-over mechanism constituted by the flap turning-over device as shown in FIGS. 10—13 (the mechanism will be referred to merely as "flap turning-over device 31 (50)" hereinafter) and is operated the motor 68*e* is rotated in the reverse direction. When backstitch data at the sewing termination point (the right end) are input, right backstitching is performed (Blocks 114, 115, 116). When the sewing pattern for the left flap has been sewn by the process described hereinabove, for thread cutting and return to point of origin (reference point), the motor 68*e* is rotated in the reverse direction based on transverse length data and then, transverse reverse skip and return to point of origin for $backlash_1$ are performed (Blocks 117, 118, 119, 120, 121, 122) to thereby complete the left flap sewing operation.

Next, description will be made of the instance in which sewing pattern data for the right flap are input. The control circuit 68*a* determines the sewing start position (Block 101). For the right flap, the sewing start position is input as the right end. Therefore, the motor 68*e* is rotated in the forward direction and transverse forward skip is performed based on transverse length data to set the sewing start point as the right end (Block 123). When backstitch at the sewing start point is input, right backstitching is performed by the motor 68*e* and sewing machine 10 (20) based on the input data (Blocks 124, 115, 116). Next, when the motor 68*e* is rotated in the forward direction based on longitudinal length data, the sewing machine 10 (20) sews right longitudinal length to sew the right flap on (Blocks 117, 105). Next, when transverse sewing and repeat sewing are input, the motor 68*e* is rotated in the reverse direction and then in the forward direction based on transverse length data to perform transverse reverse sewing and repeat sewing (Blocks 106, 125, 110, 111, 127). And when only transverse sewing is input, the motor 68*e* is rotated in the reverse direction based on transverse length data to perform transverse reverse sewing only (Blocks 106, 125, 126, 127).

Next, left longitudinal length sewing which is concealed by the right flap is performed by the sewing machine 10 (20) when the flap turning-over device 31 (50) is operated and the motor is rotated in the reverse direction based on longitudinal length data (Blocks 112, 113). When backstitch data at the sewing termination point (the left end) are input, left backstitching is performed (Blocks 114, 102, 103). When the right flap sewing pattern has been sewn by the process described just above, thread cutting and return to point of origin are performed (Blocks 104, 118, 119, 122) to thereby complete the right flap sewing.

Next, description will be made of the sewing pattern when the sewing start position is input as the left end. The control circuit determines the sewing start position (Block 101). Since the sewing start position is input as the left end, when existence or absence of backstitch at the sewing start point (the left end) is determined and backstitch is input, left backstitching is performed by the motor 68*e* and sewing machine 10 (20) based on the input data (Blocks 102, 103). Next, for sewing the left flap on, left longitudinal length is sewn (Blocks 104, 105). Next, as to the center flap, since transverse sewing is input as "absence", thread cutting is performed (Blocks 106, 107, 128). Next, for sewing the right flap on, skip is performed based on transverse length data and the sewing start point for the right flap is set (Blocks 129, 123). Next, for sewing the right flap on, right longitudinal length sewing is performed by the sewing machine 10 (20) based on longitudinal length data when the flap turning-over device 31 (50) is operated and the motor is rotated in the reverse direction (Blocks 124, 112, 113). When backstitch at the sewing termination point (the right end) is input, right backstitching is performed (Blocks 114, 115, 116). When sewing pattern for the center flap has been sewn by the process described just above, for thread cutting and return to point of origin, the motor 68*e* is rotated in the reverse direction based on transverse length data and transverse reverse skip and return to point of origin for $backlash_1$ are performed (Blocks 117, 118, 119, 120, 121, 122) to thereby complete the sewing of the center flap.

Next, description will be made of the sewing pattern when the sewing start position for the center flap is input as the right end. The control circuit 68*a* determines the sewing start position (Block 101). Since the sewing start position is input as the right end, the motor 68*e* is rotated in the forward direction based on transverse length data to perform transverse forward skip and the sewing start point is set as the right end (Block 123). When backstitch at the sewing start point is input, right backstitching is performed by the motor 68*e* and sewing machine 10 (20) based on the input data (Blocks 124, 115, 116). Next, the motor 68*e* is rotated in the forward direction based on longitudinal length data and the sewing machine 10 (20) sews right longitudinal length to sew the right flap on (Blocks 117, 105). Next, since transverse sewing for the center flap is input as "absence", thread cutting is performed (Blocks 106, 125, 126, 128). Next, for sewing the left flap on, the motor 68*e* is rotated in the reverse direction, transverse reverse skip is performed and the sewing start point for sewing the left flap is set (Blocks 129, 120). Next, for the sewing-on of the left flap, left longitudinal length is sewn by the sewing machine 10 (20) based on longitudinal length data when the flap turning-over device 31 (50) is operated and the motor 68*e* is rotated in the reverse direction (Blocks 121, 112, 113). When backstitch is input at the sewing termination point (left end), left backstitching is performed (Blocks 114, 102, 103). After the center flap sewing pattern has been sewn in the manner mentioned above, thread cutting and return to point of origin are effected (Blocks 104, 118, 119, 122) to thereby complete the sewing-on of the center flap.

With respect to the instance described just above, although it has been described that the point of origin (reference point) of the sewing pattern is the left end of the sewing pattern, the same operative effects can be obtained even when the reference point is the right end of the sewing pattern and in this case, the rotational direction of the motor for transverse direction sewing is opposite from that of the motor in the previous instance.

As described hereinabove, according to the present invention, when a flap is sewn on a flapped workpiece, it is not necessary to prepare and memorize a sewing pattern for accommodating a particular flap type and it is possible to automatically sew a flap in accordance with the type of the flap when a sewing pattern configuration is prepared and input in combination with the sewing start point and transverse sewing existence or absence.

Although preferred embodiment of the present invention have been described hereinabove, many modifications and changes may be made on the embodiments without departing from the technological scope of the present invention. Thus, it is intended that the present invention includes all the inventive conceptions set forth in the attached claims and the invention is not limited to the embodiments.

We claim:

1. A flap turning-over device for automatically turning over a flap as a sewing machine sews the lower side of said flap on a workpiece comprising:

signal producing means for notifying when said sewing machine sews said lower side of the flap;

a flap turning-over member adapted to contact said flap for turning the flap over; and a drive mechanism for causing said flap turning-over member to effect a predetermined movement in response to a signal from said signal producing means.

2. The flap turning-over device as set forth in claim 1, in which said drive mechanism comprises a first actuator for moving said flap turning-over member vertically and a second actuator for moving said flap turning-over member horizontally whereby the flap turning-over member first moves vertically and then horizontally in the flap turning-over direction when the lower end of said flap turning-over plate lies below the free end of the flap.

3. The flap turning-over device as set forth in claim 1, in which said flap turning-over member is designed to move describing a curved locus such as an elliptical, circular or parabolic locus.

* * * * *